United States Patent [19]

Pelletier et al.

[11] 3,998,028

[45] Dec. 21, 1976

[54] FURRING AND FIREPROOFING PROTECTION CLIP ASSEMBLY

[76] Inventors: John Pelletier, 42 Wellwood Circle, Rockville, Conn. 06066; Eugene H. Soucy, 16 Richard St., West Hartford, Conn. 06119

[22] Filed: May 2, 1975

[21] Appl. No.: 573,829

Related U.S. Application Data

[63] Continuation-in-part of Ser. No. 383,570, July 30, 1973.

[52] U.S. Cl. ..... 52/727; 248/228

[51] Int. Cl.[2] ..... E04C 3/30

[58] Field of Search ..... 248/72, 228, 262, 265, 248/267, 269, 300; 52/39, 241, 359, 360, 724, 725, 727, 729

[56] References Cited

UNITED STATES PATENTS

| | | | |
|---|---|---|---|
| 535,277 | 3/1895 | Dornan et al. | 248/228 X |
| 573,158 | 12/1896 | Mc Cormick | 52/359 X |
| 717,316 | 12/1902 | Avery | 248/300 X |
| 752,996 | 2/1904 | Nissenson | 248/228 X |
| 773,207 | 10/1904 | Kaiser | 248/300 X |
| 919,558 | 4/1909 | Doran | 248/72 |
| 939,368 | 11/1909 | Withem | 248/300 X |
| 1,227,194 | 5/1917 | Peterson | 248/267 |
| 1,634,364 | 7/1927 | Jakubier | 248/267 |
| 1,760,331 | 5/1930 | White | 52/725 X |
| 3,053,494 | 9/1962 | Stoll | 248/228 |

FOREIGN PATENTS OR APPLICATIONS

| | | | |
|---|---|---|---|
| 224,021 | 2/1959 | Australia | 52/725 |
| 782,120 | 9/1957 | United Kingdom | 52/724 |

*Primary Examiner*—William H. Schultz
*Attorney, Agent, or Firm*—Clarence A. O'Brien; Harvey B. Jacobson

[57] ABSTRACT

A clip assembly for attaching a member, such as a partition or duct, to a support covered with a layer of a fireproofing material while maintaining the integrity of the fireproofing layer, or attaching wallboard to a beam or column, has a pair of clip sub-assemblies adjustably connectible together to fit different size supports. Each clip sub-assembly is provided with a plate portion defining a planar support engaging surface substantially in the form of the outline of a right triangle and arranged particularly for gripping a flange of an I-beam and the like, while end walls perpendicular to the plate portions facilitate attachment of wallboard to the clip assembly for furring, and the like. Base portions, one of which has a slot and the other a plurality of spaced openings mateable to the slot, are connected to the plate portions and permit the adjustable connection of the clip sub-assemblies to various size supports.

5 Claims, 10 Drawing Figures

FIG. 3
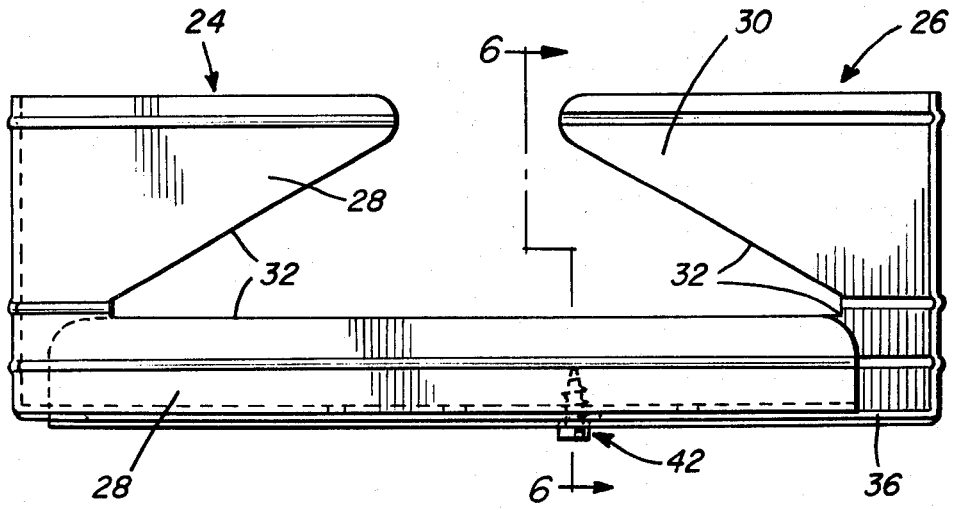
FIG. 4
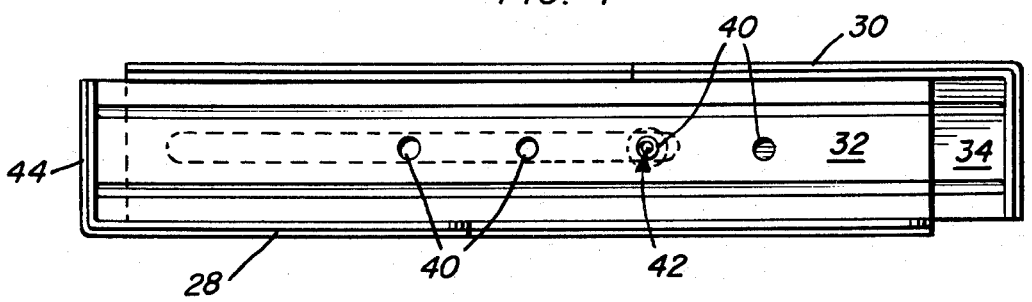
FIG. 5
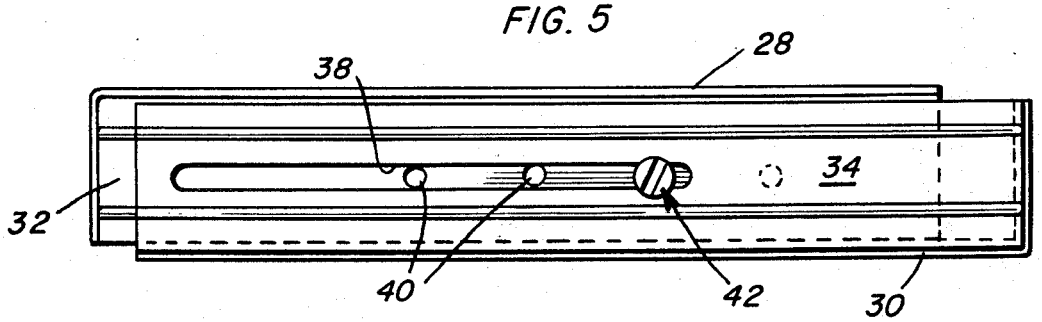
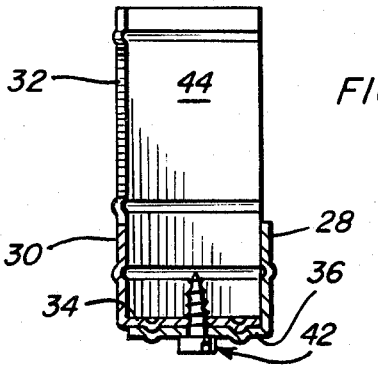
FIG. 6

FURRING AND FIREPROOFING PROTECTION CLIP ASSEMBLY

CROSS REFERENCE TO RELATED APPLICATION

This is a continuation-in-part of application Ser. No. 383,570, filed July 30, 1973.

BACKGROUND OF THE INVENTION

1. Field of the Invention

This invention relates generally to a clip assembly for attaching a member to a support, and particularly to a clip which maintains the integrity of a fireproofing protection layer covering the support on which the clip is installed, and which facilitates furring of beams, columns and spandrels.

2. Description of the Prior Art

It is known generally to attach a, for example, duct to a beam or other support by means of a suitable clip assembly. See, for example, U.S. Pat. No. 919,558, issued Apr. 27, 1909 to J. H. Doran. The known clip assemblies, however, are inflexible and limited in possible uses.

SUMMARY OF THE INVENTION

It is a primary object of the present invention to provide a clip assembly which will maintain the integrity of a fireproof layer on a support, while facilitating furring of the support.

This and other objects are achieved according to the present invention by providing a clip assembly having a pair of clip sub-assemblies adjustably connectible to one another to fit different size supports. The particular manner in which the clip sub-assemblies engage a support covered with a layer of fireproofing material will cause the integrity of the fireproofing layer to be maintained.

According to a preferred clip assembly according to the present invention, each of the clip sub-assemblies has a plate portion extending in a plane and defining in the plane a support engaging surface substantially in the form of the outline of a right triangle. This configuration is especially suited for engaging the flange of a structural member having an I-shaped cross section. The engagement of the clip sub-assemblies with the structural member only along a thin plane results in the fireproofing layer being only parted slightly without being either removed or otherwise damaged by the clip.

Advantageously, each of the clip sub-assemblies has a base portion connected to and arranged extending perpendicularly from an edge of the associated plate portion. One of these base portions may be provided with a longitudinally extending slot, and the other with spaced openings arranged for selective alignment with the slot. By arranging the spaced portions in overlapping relationship, a screw, and the like, may be used for selectively connecting together the clip sub-assemblies by passing through the slot and being anchored in one of the spaced openings.

Further, each clip sub-assembly has an end wall connected to and extending perpendicularly from both the base portion and plate portion for supporting wallboard which is furring the support.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a side elevational view showing the clip assembly of FIG. 2.

FIG. 4 is a top plan view showing the clip assembly of FIGS. 2 and 3.

FIG. 5 is a bottom plan view showing the clip assembly of FIGS. 2 to 4.

FIG. 6 is a sectional view taken generally along the line 6—6 of FIG. 3.

DESCRIPTION OF THE PREFERRED EMBODIMENTS

Figure 1:
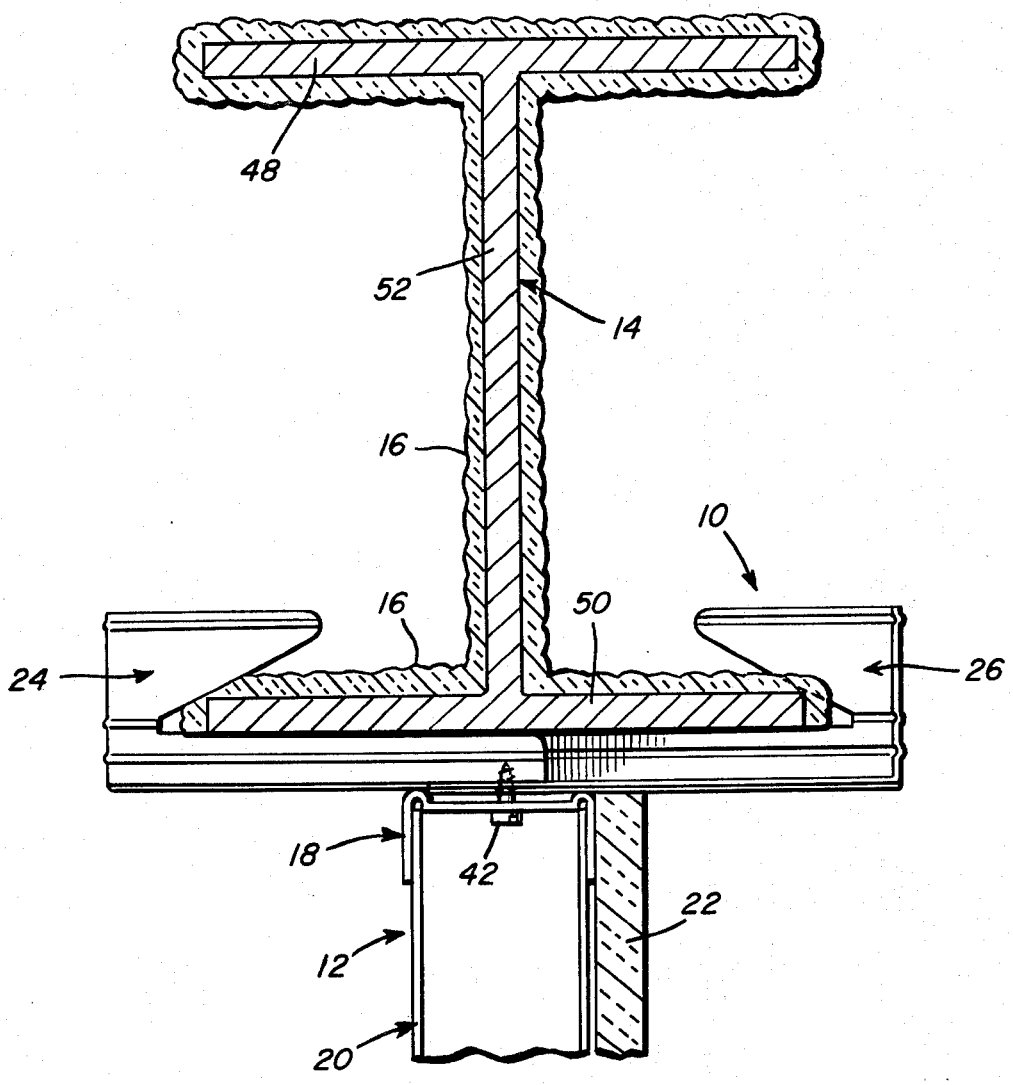
FIG. 1 is a fragmentary, sectional view showing a clip assembly according to the present invention attaching a partition to an I-beam covered with a layer of fireproofing material.
Figure 2:
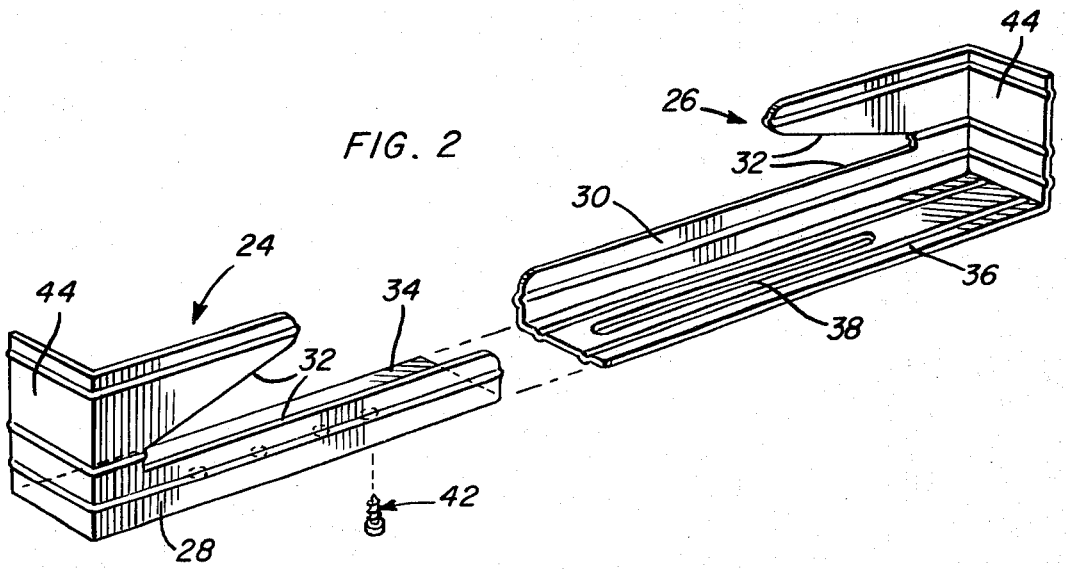
FIG. 2 is an exploded, perspective view showing a clip assembly according to the present invention.

Referring now more particularly to FIG. 1 of the drawings, a clip assembly 10 according to the present invention is shown attaching a member such as a partition 12 to a support such as a beam 14 covered with a layer of a fireproofing material 16. The latter may be constructed from, for example, glass and mineral fibers either placed on beam 14 in the form of blanket insulation or sprayed thereon in a conventional manner. Since the use of fireproofing layers on structural members is in general well known, the layer of material 16 will not be discussed in more detail herein. Partition 12 includes a top track 18 capping off a stud 20 and a fiberboard panel 22. It is track 18 which is to be connected to beam 14 by clip assembly 10. Since partition 12 may be any standard partition module, it will not be discussed in greater detail herein. It is to be understood that although the member attached to beam 14 is a partition 12, other suitable members such as a duct (not shown) may be hung from a beam 14 by the clip assembly of the present invention. Further, clip assembly 10 may be used for framing columns, and the like, in a manner also not shown.

Referring now to FIGS. 2 to 6 of the drawings, a clip assembly 10 according to the present invention has a pair of clip sub-assemblies 24 and 26 arrangeable for engaging a support. Each one of clip sub-assemblies 24, 26 has a plate portion 28, 30 extending, or disposed, in a plane and defining in that plane a support engaging surface 32 substantially in the form of the outline of a right triangle. Surfaces 32 are arranged for maintaining the integrity of a layer of a fireproofing material on the associated support by presenting a support engaging surface which merely parts the layer of fireproofing material 16 without removing it or otherwise damaging same. Clip sub-assemblies 24, 26 are selectively connectible together as by base portions 34 and 36. As can be appreciated from the drawings, the base portion 34, 36 of a respective clip subassembly 24, 26 is connected to and arranged extending perpendicularly from an edge of its associated plate portion 28, 30. One of the longitudinally extending base portions, portion 36 being designated in the drawings, is provided with an elongated slot 38 arranged extending along the longitudinal extent of its associated base portion, while the other base portion 34 is provided with a plurality of spaced openings 40 also arranged along the longitudinal extent of their associated base portion for being selectively aligned with slot 38. This alignment is best seen in FIGS. 4 to 6 of the drawings. Base portion 36 provided with slot 38 is advantageously arranged farther from beam 14 (FIG. 1) than is base portion 34 provided with openings 40. A, for example, conventional self-tapping screw may be arranged passing through slot 38 and anchored in one of the openings 40 for selectively connecting together base portions 34, 36. In this manner, clip sub-assemblies 24 and 26 are adjustably connectible together to form a clip assembly 10. End walls 44 are advantageously provided on clip sub-assemblies 24 and 26, respectively, for rigidifying the latter. Further, a plurality of longitudinally extending ribs may be arranged on the sub-assemblies 24, 26 for rigidifying same and for facilitating mating assembly of the sub-assemblies.

Referring again to FIG. 1 of the drawings, beam 14 is seen as a conventional I-beam having a pair of spaced, parallel flanges 48 and 50 connected together by a web 52. Clip sub-assemblies 24, 26 are arranged engaging one of the flanges, flange 50 as illustrated in FIG. 1 of the drawings, and partition 12 is connected to beam 14 as by screw 42 connecting together subassemblies 24 and 26. In this manner, a clip assembly 10 according to the present invention may be used to attach any appropriate member to any suitable structural member. Further, this attachment is achieved in such a manner as to maintain the integrity of the fireproofing layer on the structural member. Once clip assembly 10 is tightened down on the structural member by screw 42 the clip will be immovable thereon. Whenever the clip assembly 10 is removed from the structural member, however, the material adjacent the parted area of the unimpaired fireproofing layer can flow into the parted area and fill same.

The clip assemblies 10 according to the present invention may be installed on a, for example, beam 14 at a conventional and desirable distance from one another, suchas 4 feet on center. Not only will the clip assemblies permit a member such as a partition 12 to be securely and easily hung from a suitable support, but any fireproofing on the support will be protected substantially 100 percent.

Figure 7:
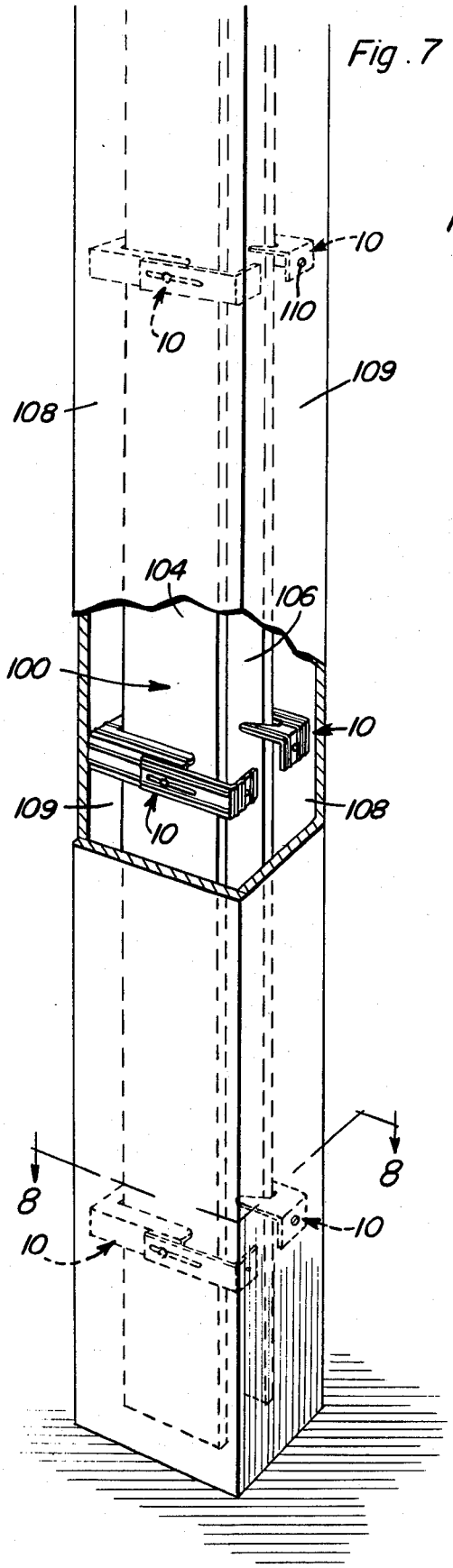
FIG. 7 is a perspective view, partly cutaway and in section, showing the use of clip assemblies according to the present invention to attach wallboard to a column.
Figure 8:
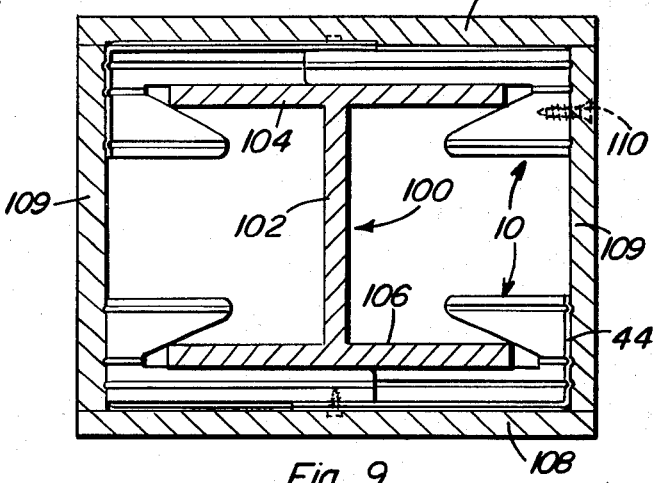
FIG. 8 is a sectional view taken generally along the line 8—8 of FIG. 7.

Referring now to FIGS. 7 and 8 of the drawings, clips 10 may be employed to facilitate the furring of a column 100, and the like. As can best be seen from FIG. 8, column 100 is a conventional I-beam, and the like, having a web 102 and flanges 104 and 106 arranged perpendicular to web 102. Sections of wallboard 108 and 109 are attached to column 100 as by clips 10 arranged on flanges 104. More specifically, pieces of wallboard 109 are attached to the end walls 44 as by conventional gypsum board screws 110, and the like. Although apertures (not shown) may be performed in end wall 44, it will be appreciated that screws 110 are self-tapping, and do not necessarily require such apertures.

As will be appreciated from the above description and FIGS. 7 and 8 of the drawings, once wallboard 109 is attached to end wall 44 of clip assemblies 10, wallboard 108 may be attached to wallboard 109 in a known manner in order to complete the enclosure of column 100. Alternatively, instead of attaching wallboard 108 to wallboard 109, wallboard 108 may be attached directly to the base portions 34, 36 of clip sub-assemblies 24, 26 as by the aforementioned screws in a manner not shown in the drawings.

Figure 9:
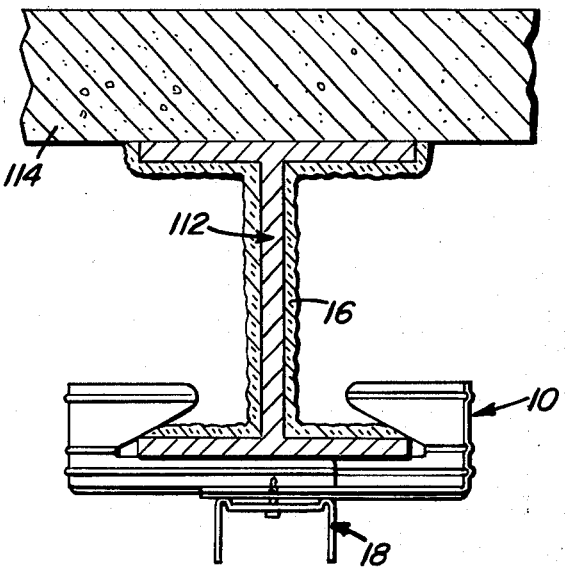
FIG. 9 is a fragmentary, sectional view similar to FIG. 1, but showing the I-beam attached to a slab, deck or wall.
Figure 10:
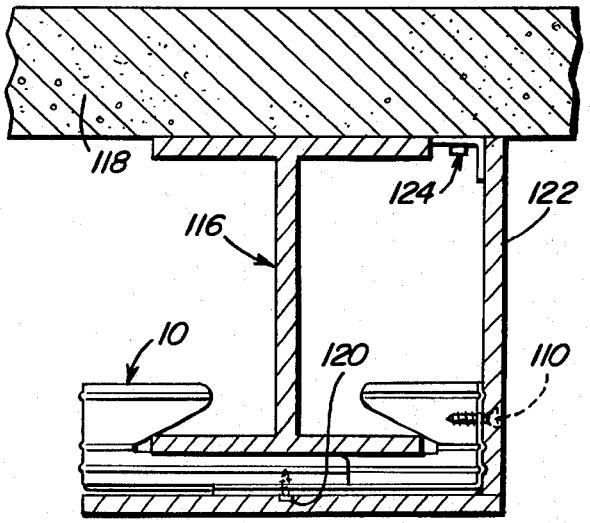
FIG. 10 is a fragmentary, sectional view similar to FIG. 9, but showing the manner in which a beam or spandrel is furred by using a clip assembly according to the present invention.

FIG. 9 of the drawings shows an I-beam, and the like, having one flange thereof attached directly to a slab, deck, or wall designated by the reference numeral 114. In the same manner, FIG. 10 shows an I-beam 116, and the like, also attached to a slab, deck, or wall, designated by the reference numeral 118, and provided with wallboard 120 and 122 for partially enclosing beam 116. It will be appreciated, of course, that beam 116 may be completely enclosed if so desired. As will also be appreciated, wallboard 120, 122 may be attached to sub-assembly 10, and/or to each other, in a manner similar to that set forth as regards the construction shown in FIGS. 7 and 8 of the drawings. Further, an angle bracket 124 is advantageously employed to connect the uppermost edge of wallboard 122 to the deck or slab designated 118.

As can be readily understood from the above description and from the drawings, a clip assembly 10 functions not only as a sprayed fireproofing protector clip assembly, but also facilitates furring and fireproofing of steel beams, columns, and the like. As a sprayed fireproofing protector clip, clip assembly 10 can be installed directly on a beam or column to which sprayed fireproofing has been applied. This is advantageous in that it allows a, for example, metal stud top runner, or top track 18, to be attached to the clip so the fireproofing will not be damaged. With clip assemblies 10 spaced on, for example, two foot centers, the rigidity of the partition is assured, while the sprayed fireproofing is left intact for full protection. The same clip assembly 10 can also be used for furring beams and spandrels in conjunction with the aforementioned gypsum board screws, and the like, applied directly to the clips for an exposed finish. The same clip assembly 10 can be used to furr and fireproof steel columns with the use of varying numbers of layers of gypsum board, and the like. For fireproofing, clip assemblies 10 are spaced on, for example, two foot centers for one layer of gypsum board, and on, for example, four foot centers when using two or three layers of board.

Clip assemblies 10 may be, for example, die cast from, for example, 22 gage galvanized sheet metal by a single manufacturer in a small shop where quality control is assured. Further, there appears to be no problems as to use-limits of clip assemblies 10, as they are concealed from sight so that there will be no limits with respect to geographical, physical/environmental and longevity considerations. Field installation is accomplished by simply loosening the screw in the male end, or sub-assembly 24, and slipping it through the female slot provided in sub-assembly 36. Clip assembly 10 is then positioned on the beam or column, and the screw 42 tightened for restraint.

Top runner or track 18 may be attached to clip assembly 10 as by screw 42 or a similar screw (not shown). One man can normally perform all operations, with no plumbing of the frame being required. Thus, the labor required to complete an entire assembly is greatly reduced. Further, the use of clip assemblies 10 eliminates backcharges due to damages to sprayed fireproofing.

A clip assembly 10 being adjustable from 6 to 14 inches dependent on thickness of the flange has been found satisfactory for use with flanges which vary from 4 to 14 inches. The distance of 6 to 14 inches for clip assembly 10 is taken between the apices of the supporting engaging surfaces 32 of each sub-assembly 24 and 26.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A clip assembly for attaching a member to a support covered with a fireproofing material, comprising, in combination:

a. a pair of clip sub-assemblies, each one of the clip subassemblies provided with a surface arranged for engaging a support and maintaining the integrity of a layer of a fireproofing material selectively provided on the support, the support engaging surface including a plate portion extending in a plane and defining in the plane a surface substantially in the form of the outline of a right triangle, and each of the clip sub-assemblies including a base portion connected to and arranged extending perpendicularly from an edge of the associated plate portion, and further including an end wall connected to and arranged extending perpendicularly from both the base portion and the plate portion along parallel edges of the base and plate portion, each of the plate portions and end walls being arranged along a common edge of the respective base portions, the end walls arranged for selectively supporting wallboard furring the support;

b. attaching means associated with the base portions of the clip sub-assemblies for selectively and adjustably connecting the sub-assemblies to one another; and c. a support member having a pair of spaced, parallel flanges connected together by a web and providing a cross-section in the form of an I, the support engaging surfaces of the clip sub-assemblies being arranged engaging respective ones of the flanges, a member supported adjacent the support member by the clip assembly formed from the clip sub-assemblies, and wallboard attached to the end walls of the clip sub-assemblies and spaced from the flanges for partially enclosing the support.

2. A structure as defined in claim 1, wherein the attaching means includes one of the base portions being provided with a slot and the other with a plurality of spaced openings arranged for selective alignment with the slot, and means for selectively securing the base portions to one another, the base portion being provided with the slot arranged further from the support than is the base portion provided with the spaced openings, and the means for securing being a self-tapping screw arranged passing through the slot and anchored in one of the spaced openings.

3. A structure as defined in claim 2, further including a support having a pair of spaced, parallel flanges connected together by a web and providing a cross section in the form of an I, the support engaging surfaces of the clip sub-assemblies being arranged engaging respective ones of the flanges, a member connected to the base plates and arranged attached to the support by the clip assembly formed from the clip sub-assemblies, and wallboard attached to the end walls of the clip sub-assemblies for partially enclosing the support.

4. A structure as defined in claim 3, further including an angle bracket connected to the wallboard along an edge thereof and to a structural member supporting the support for connecting the wallboard to the structural member.

5. A structure as defined in claim 1, further including an angle bracket connected to the wallboard along an edge thereof and to a structural member supporting the support for connecting the wallboard to the structural member.

* * * * *